United States Patent [19]

Stegelitz

[11] 4,127,441

[45] Nov. 28, 1978

[54] PAPER MACHINE WIRE DRAPING SYSTEM

[75] Inventor: Wilhelmus J. Stegelitz, Lachine, Canada

[73] Assignee: Dominion Engineering Works Limited, Lachine, Canada

[21] Appl. No.: 855,712

[22] Filed: Nov. 29, 1977

[51] Int. Cl.[2] ..... D21F 1/26

[52] U.S. Cl. ..... 162/200; 162/273

[58] Field of Search ..... 162/200, 273

[56] References Cited

FOREIGN PATENT DOCUMENTS 438,586 12/1946 Canada.

874,194 6/1971 Canada ..... 162/200

*Primary Examiner*—Richard V. Fisher

*Attorney, Agent, or Firm*—R. A. Eckersley

[57] ABSTRACT

A draping system, for use in clothing a pulp forming section with an endless belt, has a rigid top frame to receive a plurality of substantially rigid poles in mutually parallel, loop supporting relation thereon, and a lightweight lower frame having semi-rigid poles for insertion within the loop of the belt and detachable spacers for holding the semi-rigid poles in spaced apart relation, the lower frame being sufficiently light to be readily supported within the belt in loop extending relation by the belt, for transverse insertion into a forming section.

3 Claims, 4 Drawing Figures

FIG.1.
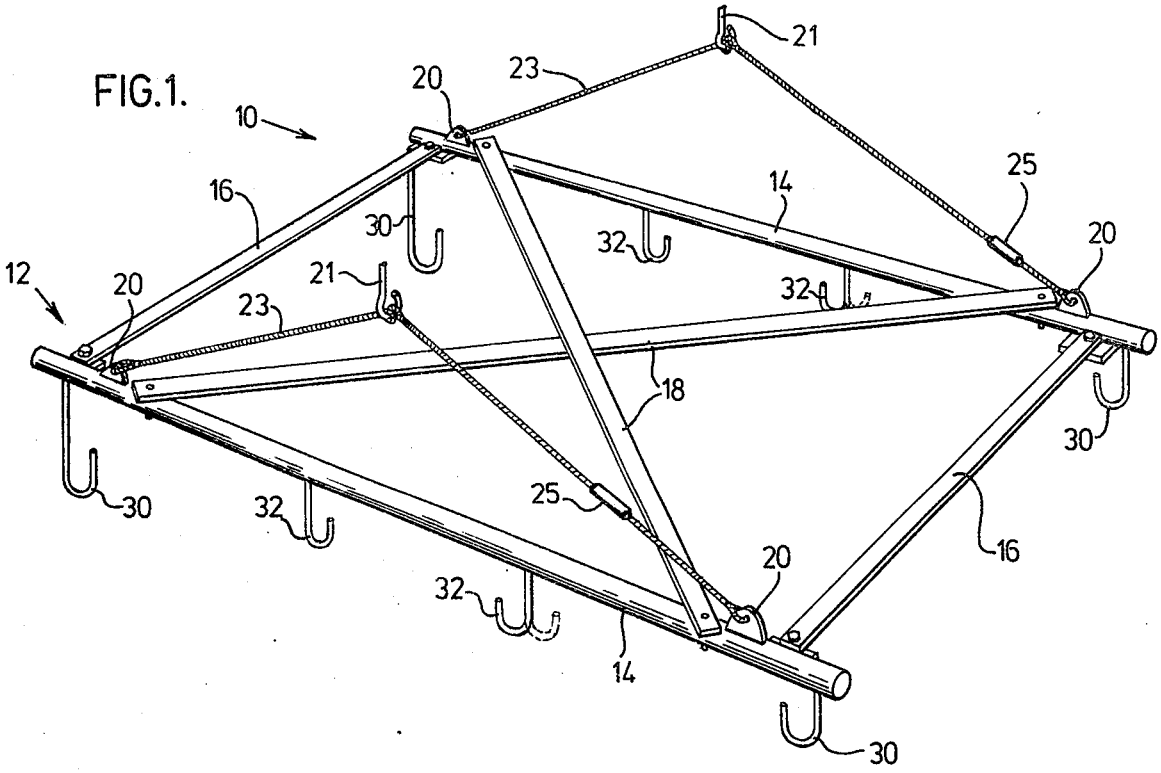
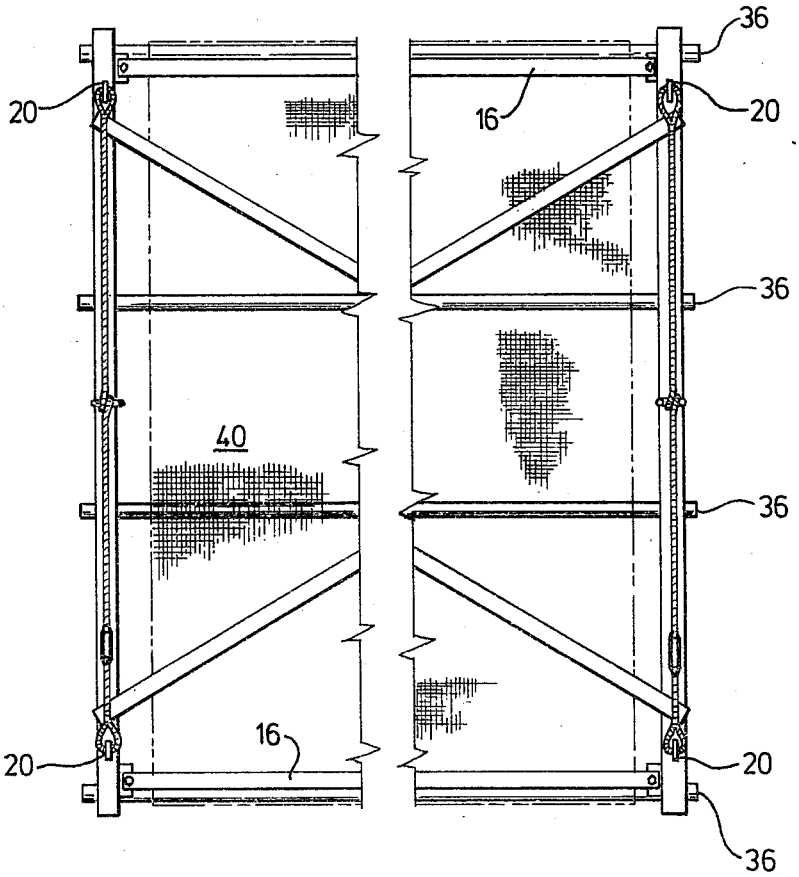
FIG.2.

PAPER MACHINE WIRE DRAPING SYSTEM

This invention is directed to a system for draping a replacement foraminous belt in a pulp forming section such as a paper machine, and includes a frame arrangement by which the belt is carried into the machine.

BACKGROUND OF THE INVENTION

In the pulp and paper industry the heart of the forming machine is the one or more foraminous belts by means of which the pulp is dewatered and on which a web is formed. These belts by which the machine is "clothed" may comprise synthetic fabric or woven bronze wire, depending on the particular machine involved, and its selected use.

In the particular case of twin wire machines, owing to the increased complexity of the forming path followed by the belts in passing over the rolls of the machine, and the diminished clearances existing within the machine between its various components, allied to the great widths of the machines and the difficulty in providing abundant aisle space at the front of the machine in which to carry out the fabric draping operation, the requirements for satisfactory draping are becoming more and more difficult to meet. The primary requirements are that the belt shall be installed rapidly, without damage and without ridging or wrinkling.

Prior arrangements, such as that of Canadian Pat. No. 438,586 — Hornbostel, Dec. 17, 1946 and Canadian Pat. No. 874,194 — Soomet et al., June 29, 1971 utilize rigidly supported arrangements having elaborate mounting means for supporting the belt in draped relation, and for laterally displacing the draping frame with the belt into the forming section. Such arrangements are space consuming and comparatively inflexible in their arrangement and use.

BRIEF SUMMARY OF THE INVENTION

The present disclosure provides a belt replacement system for draping a replacement belt on a pulp forming machine such as a paper machine, wherein a plurality of substantially rigid poles are extended transversely through the loop of the belt to extend beyond the edges of the belt; a portable, rigid top frame is spaced over the belt and the ends of the rigid poles secured thereto in supported relation by the frame; a plurality of light-weight poles are inserted transversely to extend through the belt; light-weight spacer means are connected between at least two of the light-weight poles to secure them in mutually spaced apart relation, and the rigid frame means is displaced so as to carry the replacement belt in extended relation over roll members of the machine extending in freely supported relation to receive the belt in transversely inserted relation thereover, the light-weight poles and spacer means being freely supported by the fabric of the belt, to maintain the belt in a substantially unwrinkled condition for transverse insertion, and manipulation about the surfaces of the rolls.

It will be understood by one skilled in the art that in the arrangement of such web forming machines it is commonplace to provide replaceable stools adjacent the front aisle of the machine and roll support means to secure many of the rolls in supported cantilevered relation from the remote side of the machine, whereby the forming section is accessible from the front aisle for the placement of a replacement belt in supported relation about the cantilevered rolls. It is the transfer of the replacement belt in an unwrinkled condition within the forming section to which this invention is directed.

The invention provides the advantages of low cost; greater flexibility by the provision of two independent (top and bottom) frame assemblies; and utilization of the transverse flexibility characteristics of the fabric loop, leading to reduced down time for loop replacement.

BRIEF DESCRIPTION OF DRAWINGS

Certain embodiments of the invention are herein described, reference being made to the accompanying drawings, wherein:

FIG. 1 is a general view of a top frame according to the present invention;

FIG. 2 is a plan view of the top frame of FIG. 1;

DETAILED DESCRIPTION OF THE INVENTION

Figure 3:
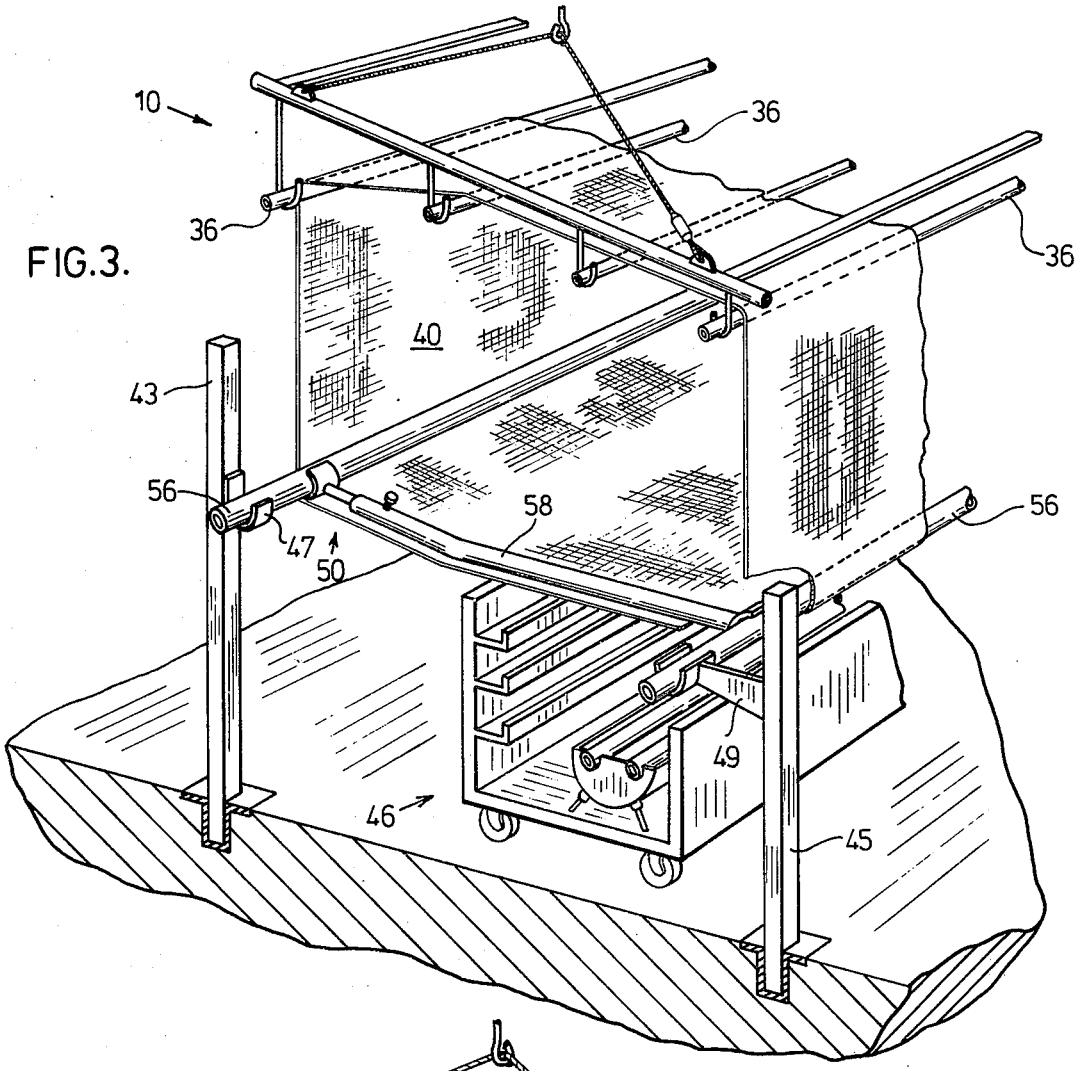
FIG. 3 is a general view of a portion of the arrangement showing draping of the belt in the machine front aisle.

Referring to FIG. 1, there is provided a top frame assembly 10 having a rectangular frame 12 with longitudinal end members 14, transverse spacers 16, and diagonal brace members 18 pinned to the longitudinal end members 14. The spacers 16 and brace members 18 made readily detachable from end members 14 to facilitate break-down and storage of the frame 12. The transverse spacers 16 are made detachable by suitable bolting provision. The use of T-piece sockets attached to the end members 14 each having a socket portion to receive one end of a spacer 16 in sliding relation therein also is contemplated.

The frame 12 has four lugs 20 by which frame 12 may be adjustably slung to a pair of crane hooks 21 by way of slings 23 having turnbuckles 25.

Hook means comprising four corner hooks 30 extend downwardly from the frame end members 14, with a further four intermediate hooks 32 attached therebetween. At least one pair of these intermediate hooks 32 are pivotally attached to the respective end members 14, to permit reversed orientation of the hooks, as indicated in phantom, for purposes of facilitating the attachment and detachment of poles thereat.

Figure 4:
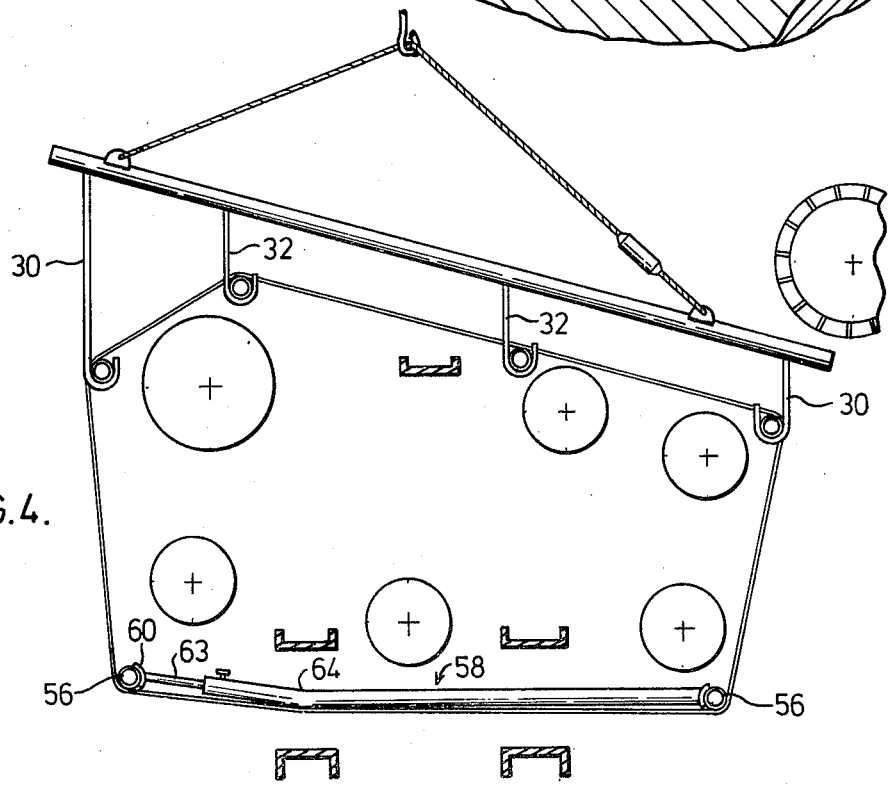
FIG. 4 is a schematic side view showing the draping frame and belt in assembled relation with the rolls of one half of a two-belt forming section.

Referring to FIGS. 2, 3 and 4, a plurality of substantially rigid poles 36 are supported from the hooks 30, 32, carrying an upper portion of belt 40 in supported relation thereon.

FIG. 3 illustrates the top frame assembly 10 together with the top pole set 36 having the belt 40 thereon, a set of four corner posts 43, 45 in the machine front aisle comprising two of each type, and a stringing buggy 46 on which the replacement belt is carried. In addition a lower frame assembly 50 is shown, having a pair of light-weight poles 56 held in spaced apart relation by means of adjustable spacers 58, only one of which is illustrated. The spacers 58 each has a stirrup end 60 for pinning attachment to the pole 56, being attached by strut 63 in sliding adjustable relation with the tube portion 64, to permit variation of the effective length of the respective spacers 58.

MODE OF OPERATION OF THE INVENTION

The corner posts 43, 45 are illustrated as being removeably supported in the front aisle adjacent the machine forming section, with the stringing buggy 46 of usual type located between the posts, and removeable there-from. The posts 43, 45 are provided with brackets 47, 49 by which the light-weight lower poles 56 are supported as the belt is off-loaded from the buggy 46 in the front aisle.

It will be evident that in addition to occupying little space when disassembled, the subject belt stringing arrangement may be readily and rapidly assembled in the front aisle while the web forming section continues to operate. The belt is readily positioned on the top poles, and the weight of the lower frame is easily supported by the fabric of the belt 40. With the machine at a standstill, and appropriately prepared, the positioning of the belt by means of the lower frame, in order to manipulate the belt over the requisite rolls of the forming section is effected by hand, with a man positioned at each of the four corners of the lower frame.

What I claim as new and desire to secure by Letters Patent of the United States is:

1. In a method of stringing a wide endless belt, such as a paper machine fabric, for transverse insertion over the rolls of a pulp forming machine, the steps comprising inserting a plurality of substantially rigid poles to extend transversely through the loop of the belt and beyond the edges thereof; positioning a rigid portable frame in spaced location above the belt, said frame having a plurality of pairs of pole supports to receive said poles in end supported, mutually spaced parallel relation thereon; lifting each said rigid pole to a respective pair of said supports while conveying a portion of said belt in supported relation thereon; securing said poles to the respective said supports; inserting within the loop of the belt a light-weight lower frame comprising a plurality of semi-rigid light-weight poles to extend transversely through the belt; connecting spacer means between said semi-rigid poles, to secure them in spaced apart relation; and raising said portable frame, to lift said rigid poles having said belt suspended thereon, whereby said loop raises said semi-rigid poles and said spacer means in freely supported relation within the loop, for transverse positioning of the loop within the plan view periphery of said forming machine.

2. A belt draping frame for use with a pulp forming section, for positioning a wide endless loop of a belt on elements of said section, comprising: top frame means having a substantially rigid portable frame; attachment means for securing the frame to frame transfer means; at least two pairs of pole suspension means extending from said frame to receive a plurality of belt support poles in detachably secured relation thereto; a plurality of said support poles; and a light-weight frame means having at least two poles and pole spacing means to secure said two poles in generally parallel relation, being attachable to said two poles within said belt loop to provide a frame sufficiently light in weight to be safely raised by the belt while maintaining the belt in a looped, substantially unridged condition for passage into the section.

3. The draping frame as claimed in claim 2 wherein said pole suspension means include intermediate hook means pivotally suspended from said top frame means, to facilitate attachment of said support poles to the top frame means.

* * * * *